US005660577A

United States Patent [19]

Modena

[11] Patent Number: 5,660,577

[45] Date of Patent: Aug. 26, 1997

[54] BRASSIERE

[75] Inventor: Giovanna Modena, Bergamo, Italy

[73] Assignee: Lovable Italiana S.p.A., Grassobbio, Italy

[21] Appl. No.: 318,605

[22] PCT Filed: Aug. 26, 1992

[86] PCT No.: PCT/IT92/00107

§ 371 Date: Oct. 6, 1994

§ 102(e) Date: Oct. 6, 1994

[87] PCT Pub. No.: WO93/22942

PCT Pub. Date: Nov. 25, 1993

[51] Int. Cl.[6] ..... A41C 3/00; A41C 3/12

[52] U.S. Cl. ..... 450/86; 2/73; 450/41; 450/53; 450/60

[58] Field of Search ..... 2/73; 450/54, 55, 450/56, 57, 58, 59, 60, 61, 62, 63, 64, 65, 66, 67, 68, 70, 74, 75, 76, 77, 78, 79, 80, 86, 41–53

[56] References Cited

U.S. PATENT DOCUMENTS

| | | | |
|---|---|---|---|
| 2,100,890 | 11/1937 | Witkower | 450/61 X |
| 2,497,324 | 2/1950 | Schenkman | 450/63 |
| 2,533,060 | 12/1950 | Silvaen | 450/86 X |
| 2,623,212 | 12/1952 | Halper | 450/60 |
| 2,773,261 | 12/1956 | Schaumer | 450/86 X |
| 2,782,416 | 2/1957 | Ginsburg | 450/55 |
| 3,186,412 | 6/1965 | Kurland | 128/483 |
| 3,263,685 | 8/1966 | Bernfeld | 450/65 |
| 3,548,832 | 12/1970 | Kosner | 450/70 X |
| 3,717,154 | 2/1973 | Spetalnik | 450/70 |
| 4,174,717 | 11/1979 | Schreiber et al. | 128/494 |
| 4,324,254 | 4/1982 | Freedman et al. | 128/494 |
| 5,045,019 | 9/1991 | Capasso et al. | 450/65 X |
| 5,171,182 | 12/1992 | Heinen | 450/86 |

FOREIGN PATENT DOCUMENTS

| | | | |
|---|---|---|---|
| 8246275 | 6/1977 | Australia . | |
| 0995726 | 9/1951 | France | 450/55 |
| 1271174 | 7/1961 | France | 450/86 |
| 2135727 | 12/1972 | France . | |
| 2034172 | 6/1980 | United Kingdom . | |

*Primary Examiner*—Jeanette E. Chapman

*Attorney, Agent, or Firm*—Panitch Schwarze Jacobs & Nadel, P.C.

[57] ABSTRACT

A brassière in which each cup (1,2), connected to both an elastic band (4) and a respective shoulder strap (7,8), consists, in its lower and lateral parts, of a continuous band (3,3') made of low-stretch fabric.

7 Claims, 1 Drawing Sheet

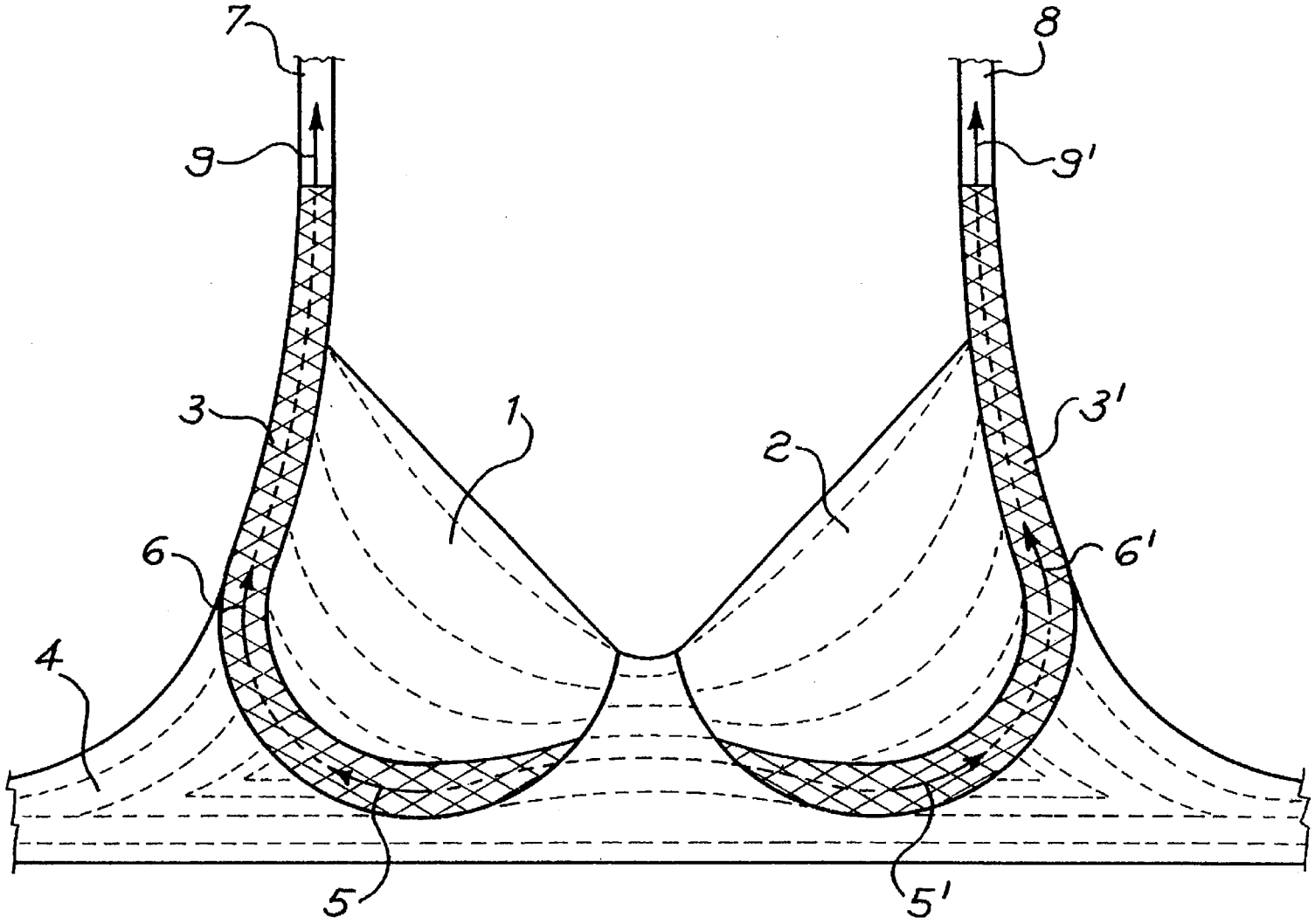
8
9'
3'
6'
5'
2
1
7
9
3
6
4
5

BRASSIERE

The present invention relates to the brassières and particularly to an improved brassière.

It is known that, in order to obtain a particular effectiveness in both supporting and containing the breasts, several types of brassières are provided with a so called underwire. This consists of a support, made either of metal or a different substantially rigid material, arranged at the base of the brassière cups, whereby each cup can be strained only within the limit of the geometric shape imposed by the underwire itself. In such a way, the push exerted by the breasts is completely borne by the underwire and therefore the containing forces act on horizontal planes.

The main drawback of the brassières provided with an underwire is that they are very uncomfortable due to the presence of a substantially rigid element pressed on the thorax at the base of the breasts.

A greater comfort is vice versa ensured by the brassières being completely made of fabric but having, on the other hand, a poorer supporting and containing action. In fact, while a substantially rigid element like an underwire can bear, through a bending, the strain exerted on the fabric of each cup, with consequent pulling and compression of the internal structure of the underwire, this is not possible for the only fabric which can effectively bear only pulling stresses. Therefore said pulling stresses spread, in a usual brassière, to the whole fabric, with both a consequent dispersion of them and less effective support and containment of the breasts. U.S. Pat. No. 4,324,254 discloses a brassière without underwire which comprises a circumferential stretchable band extending around the body of the wearer; when the brassière is worn. However, this stretchable band does not extend upwards and is not connected to the shoulder straps. No breast supporting and containing action is performed by said band. It only serves to anchor the brassière to the body of the wearer so as to oppose undesirable displacements.

Thus the object of the present invention is to provide an article of lingerie which is effective both in supporting and containing the breasts and, at the same time, particularly easy-fitting and comfortable to be worn.

Such an object is attained by a brassière comprising two cups connected to both an elastic band and respective shoulder straps, in which each cup consists, in its lower and external lateral parts, of a continuous band connected at the top to respective shoulder straps, said continuous band being made of a low-stretch fabric which is less elastic than the remaining fabric of the cups.

The brassiere according to the present invention has also the advantage of allowing the adjustment at will of the breast-supporting effect. In fact, as it will be clear in the following, the two bands made of low-stretch fabric form a preferential way for the distribution of the breast-supporting stress and therefore, by varying the tension of the brassière straps directly connected to said bands, the support degree of the respective cups can be adjusted.

These and other advantages of the improved brassière according to the present invention will be clear from the following detailed description with reference to the attached sole drawing which shows a front schematic view of a preferred embodiment of this article of lingerie.

The brassière consists of two cups 1,2 connected, in correspondence with respective bands 3,3' made of low-stretch fabric, to an elastic band 4 as well as to respective shoulder straps 7,8. Said bands 3,3' made of low-stretch fabric form both the lower part and lateral part of each brassiere cup 1,2 and constitute a particular element of continuity between each cup and the respective strap. By virtue of this element of continuity, in this kind of brassière, a new scheme for both the distribution and the transferring of the stresses is realized. In fact, the continuity of the stiffening in the lateral and lower parts of each cup ensures the transmission, along the low-stretch band, of the mechanical tension due to both the respective strap and the elastic band 4, thus ensuring a particular support and lateral containment, as schematically shown by respectively the arrows 5,6 and 5',6'.

As the band made of low-stretch fabric is less elastic than the remaining fabric of the cups, it completely bears the strain due to the tension of the shoulder straps which is schematically represented by the arrows 9,9', whereby each cup results to be contained in a stiffened structure, similarly to what happened in the normal brassières by using the underwire. Actually, in the brassière according to the present invention the real rigid element has been eliminated and the characteristic of rigidness has been transferred to a suitably manufactured fabric band. It is clear that in this case the bending stress typical of the underwire does not apply, and that the supporting and containing effects are exclusively obtained by means of pulling stresses, which represent the best operating conditions for a fabric.

It should be pointed out the importance for the two bands 3,3' to be formed by a continuous fabric in order to obtain a preferential way for spreading the stress, which constitutes the main feature of the brassiere according to the present invention. The two bands 3,3' made of low-stretch fabric thus form a ring-like structure around the breasts with breast-supporting and containing effects similar to those of the usual brassières provided with an underwire, but obtained with a much more comfortable as well as easy-fitting brassière.

This article of lingerie moreover allows to obtain different degrees in the breast-supporting action which can be adjusted at will by either slackening or tightening the shoulder straps, thereby varying the mechanical tension on the lowstretch fabric bands.

The bands 3,3' made of low-stretch fabric and forming a respective part of the cups 1,2 are preferably made in "FIBER-FILL" laminated by "JERSEY COTTON" but they can be made of whatever material is suitable to this purpose. Clearly, each of said bands made of low-stretch fabric can be wider or narrower depending on the article size and it is also possible for a band to have a varying width along its length from the lower part of the respective cup to the corresponding shoulder strap. It is particularly preferable, for obtaining a better breast-supporting action, that each band has a greater width in the lower part of the respective cup.

The bands made of low-stretch fabric can also either completely or partially form the respective shoulder strap of the brassiere, and they can possibly be connected to each other in correspondence with the front part of the elastic band 4, thus forming a single band. It is further possible to make frontally closed brassières having the improvement of the present invention, as well as brassières of the type having padded cups. The peculiar feature of the present invention can be also applied to the brassières for breast feeding which therefore will have each cup and corresponding band suitable to be opened. It is also possible to realize brassières according to the present invention in which, to allow the wearing of particularly low cut dresses, the part of each cup consisting of normal fabric is eliminated, whereby each cup is reduced to the sole band which both laterally and below surrounds the breasts.

It is finally possible to employ a brassière according to the present invention as a component part of complex underwear such as girdles, bodies, body-shapers and the like.

I claim:

1. An underwireless brassiere comprising a body encircling band member, a pair of breast cups connected to said body encircling band member, each cup comprising an upper wall portion and a continuous lower and lateral band wall portion which forms the entire lower and lateral portion of the cup to distribute a breast-supporting stress of each breast, said upper wall portion being of a different material which has a different stiffness than the continuous lower and lateral band wall portion, the continuous lower and lateral band wall portion comprising a low-stretch fabric which is less elastic than the fabric of the upper wall portion of the cup, a pair of shoulder straps each directly connected to a top end portion of each respective continuous lower and lateral external band wall portion for transferring the breast-supporting stress from each band wall portion to the shoulder strap, each lower and lateral band wall portion acting on a lower and lateral external portion of each breast to support and contain each breast in a respective cup.

2. A brassiere according to claim 1, characterized in that each continuous lower and lateral band wall portion has a variable width along its length.

3. A brassiere according to claim 1, characterized in that each continuous lower and lateral band wall portion has a greater width in the lower portion of the respective cup.

4. A brassiere according to claim 1, characterized in that each cup is limited to only the respective continuous lower and lateral band wall portion.

5. A brassiere according to claim 1, characterized in that the continuous lower and lateral band wall portions are linked to each other in a front zone of the body encircling band, said front zone being located between the cups.

6. A brassiere according to claim 1, characterized in that the continuous lower and lateral band wall portions are made of FIBER-FILL laminated by JERSEY COTTON.

7. An article of lingerie having an underwireless brassiere comprising a body encircling band member, a pair of breast cups connected to said body encircling band member, each cup comprising an upper wall portion and a continuous lower and lateral band wall portion which forms the entire lower and lateral portion of the cup to distribute a breast-supporting stress of each breast, said upper wall portion being of a different material which has a different stiffness than the continuous lower and lateral band wall portion, the continuous lower and lateral band wall portion comprising a low-stretch fabric which is less elastic than the fabric of the upper wall portion of the cup, a pair of shoulder straps each directly connected to a top end portion of each respective continuous lower and lateral external band wall portion for transferring the breast-supporting stress from each band wall portion to the shoulder strap, each lower and lateral band wall portion acting on a lower and lateral external portion of each breast to support and contain each breast in a respective cup.

* * * * *